US010395870B2

(12) United States Patent
Bobert

(10) Patent No.: US 10,395,870 B2
(45) Date of Patent: Aug. 27, 2019

(54) RELAY WITH FIRST AND SECOND ELECTROMAGNETS FOR PLACING AND KEEPING A CONTACT IN A CLOSED STATE

(71) Applicant: EPCOS AG, Munich (DE)

(72) Inventor: Peter Bobert, Falkensee (DE)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 14/903,571

(22) PCT Filed: May 21, 2015

(86) PCT No.: PCT/EP2015/061300
§ 371 (c)(1),
(2) Date: Jan. 7, 2016

(87) PCT Pub. No.: WO2015/185371
PCT Pub. Date: Dec. 10, 2015

(65) Prior Publication Data

US 2016/0172138 A1 Jun. 16, 2016

(30) Foreign Application Priority Data

Jun. 4, 2014 (DE) ..... 10 2014 107 884

(51) Int. Cl.
*H01H 50/36* (2006.01)
*H01H 50/86* (2006.01)
(Continued)

(52) U.S. Cl.
CPC ..... *H01H 50/36* (2013.01); *H01H 47/04* (2013.01); *H01H 50/045* (2013.01); *H01H 50/86* (2013.01)

(58) Field of Classification Search
CPC ..... H01H 47/04; H01H 50/86; H01H 50/36; H01H 50/045
(Continued)

(56) References Cited

U.S. PATENT DOCUMENTS 2,889,423 A 6/1959 Yochum
7,061,352 B2 * 6/2006 Lin ..... H01H 47/08 335/108
(Continued)

FOREIGN PATENT DOCUMENTS

DE 757577 C 8/1951
DE 102004013900 A1 10/2005
(Continued)

OTHER PUBLICATIONS

MAGNETbasics: "Elektromagnete", http://www.magnetbasics.de/elektromagnete/topfmagnet.htm, with English translation.
(Continued)

*Primary Examiner* — Bernard Rojas
(74) *Attorney, Agent, or Firm* — Morgan, Lewis & Bockius LLP

(57) ABSTRACT

The present invention relates to a relay (1), having a first terminal (2), a second terminal (3), a contact (4) which in a closed state brings about an electrical connection between the first and second terminals (2, 3) and which in an opened state electrically disconnects the first and second terminals (2, 3), a first electromagnet (5) which is configured in such a way that it places the contact (4) in the closed state if the first electromagnet (5) is switched on, and a second electromagnet (6) which is configured in such a way that it keeps the contact (4) in the closed state if the contact (4) is in the closed state and the second electromagnet (6) is switched on.

12 Claims, 3 Drawing Sheets

(51) Int. Cl.
*H01H 47/04* (2006.01)
*H01H 50/04* (2006.01)

(58) Field of Classification Search
USPC ..... 335/234
See application file for complete search history.

(56) References Cited

U.S. PATENT DOCUMENTS

| | | | | |
|---|---|---|---|---|
| 8,686,814 | B2 * | 4/2014 | Bach | H01H 3/222 335/131 |
| 9,013,254 | B2 * | 4/2015 | Molyneux | H05K 5/06 335/205 |
| 9,105,431 | B2 * | 8/2015 | Sora | H01H 50/44 |
| 9,595,411 | B2 * | 3/2017 | Shimizu | H01H 50/44 |
| 2004/0027776 | A1 | 2/2004 | Uotome et al. | |
| 2005/0162246 | A1 | 7/2005 | Lin | |
| 2010/0271155 | A1 * | 10/2010 | Kaneda | F02N 15/067 335/126 |
| 2012/0068477 | A1 | 3/2012 | Bradfield | |

FOREIGN PATENT DOCUMENTS

| | | | |
|---|---|---|---|
| DE | 102004032373 | A1 | 1/2006 |
| DE | 69734440 | T2 | 5/2006 |
| DE | 102009052938 | A1 | 11/2010 |
| DE | 102012108630 | A1 | 3/2013 |
| DE | 112011103156 | T5 | 7/2013 |
| EP | 1353348 | A1 | 10/2003 |
| JP | S39006282 | | 3/1964 |
| JP | S56157713 | U | 11/1981 |
| JP | H07134934 | A | 5/1995 |
| JP | 2003197082 | A | 7/2003 |
| JP | 2003229043 | A | 8/2003 |
| JP | 2005163737 | A | 6/2005 |
| JP | 2005235515 | A | 9/2005 |
| JP | 2006108041 | A | 4/2006 |
| JP | 2010257881 | A | 11/2010 |

OTHER PUBLICATIONS

MAGNETbasics: "Linearmagnete (Hubmagnete)", http://www.magnetbasics.de/hubmagnete/monostabil.htm, with English translation.

* cited by examiner

RELAY WITH FIRST AND SECOND ELECTROMAGNETS FOR PLACING AND KEEPING A CONTACT IN A CLOSED STATE

The present invention relates to a relay. A relay is an electromagnetically active switch which operates by means of electric current and has at least two switch positions.

Relays are necessary in a wide variety of fields of use for electrically disconnecting and electrically connecting two terminals. One field of use of relays is, for example, electrically operated vehicles. High DC voltages which are to be connected and disconnected by means of the relay frequently occur in these vehicles. In order to load the capacity of the battery of the electrically operated vehicle as little as possible, the consumption of energy by the relay should be as small as possible.

The object of the present invention is correspondingly to make available an improved relay which has, for example, a reduced energy requirement.

This object is achieved by means of a relay according to the present claim 1.

A relay is proposed which has a first terminal, a second terminal, a contact which in a closed state brings about an electrical connection between the first and second terminals and which in an opened state electrically disconnects the first and second terminals, a first electromagnet which is configured in such a way that it places the contact in the closed state if the first electromagnet is switched on, and a second electromagnet which is configured in such a way that it keeps the contact in the closed state if the contact is in the closed state and the second electromagnet is switched on.

The first and the second electromagnet are two electromagnets which are separate from one another. Each of the two electromagnets can be switched on and off in the relay independently of the respective other electromagnet.

It has therefore been recognized that it is possible to subdivide the method of functioning of the relay into two different sub steps, the closing of the contact and keeping the contact closed. A different electromagnet is responsible for each of these sub steps so that only the actually required energy consumption occurs in each of these sub steps. In particular, in the closed state of the contact said contact can be kept closed merely by the second electromagnet. In this context, the second electromagnet can be configured in such a way that it has a lower energy consumption than the first electromagnet, wherein in each case the energy consumption in the switched-on state of the electromagnets is considered.

The first electromagnet only has to be switched on for the chronologically comparatively short closing of the contact. Accordingly, a relatively high energy consumption by the first electromagnet hardly has any effect in a total energy balance of the relay, since the switch-on time of the first electromagnet can be very short compared to the second electromagnet.

Since the first electromagnet is always switched on only briefly, the first electromagnet can be operated in an overdriven fashion in accordance with the short switch-on time. In particular, a magnet which has a chronologically limited switch-on period can be used as the first electromagnet. The first electromagnet can also have a compact design, since, for example, the cooling of this magnet is uncritical because of the very short switch-on period.

The second electromagnet can also be relatively small, since an electromagnet with a low current consumption can be used here.

The contact has a closed state and an opened state. The contact can be connected mechanically to the first electromagnet, with the result that the first electromagnet can transfer the contact from the opened state into the closed state. In addition, in its closed state the contact can bear against the second electromagnet, with the result that the second electromagnet can keep the contact in the closed state.

In addition, the second electromagnet can be dimensioned in such a way that its magnetic field is strong enough to keep the contact in the closed state, and that its magnetic field is too weak to move the contact from the opened state into the closed state. The second electromagnet can in this way be adapted in ideal fashion to the requirement to keep the contact closed with a minimum energy consumption.

In addition, the second electromagnet can be configured in such a way that it keeps the contact in the closed state if the first electromagnet is switched off. Accordingly, the first electromagnet is required only for moving the contact from its opened state into its closed state. As soon as the contact has reached the closed state, the first electromagnet can be switched off, with the result that no further energy is required for this electromagnet.

The relay can be configured in such a way that the first electromagnet is switched off by a switching process of the contact from the opened state into the closed state. In this way, it is possible to ensure that the first electromagnet is switched off as soon as it is no longer required for the function of the relay. Accordingly, only the minimum required amount of energy is consumed by the first electromagnet.

The relay can also have a device which switches off the first electromagnet if the contact is in the closed state. This device can be, for example, a micro switch which is activated as soon as the contact has reached the closed state.

In addition, the relay can have a timer switch which switches off the first electromagnet after a predefined time after the contact has been moved from the opened state into the closed state. The device can be, for example, a capacitor via which current can initially flow, with the result that the first electromagnet is switched on, and which capacitor has also reached its maximum charge after a predetermined time and then switches off, as a result of which the first electromagnet is switched off. Other devices which switch off the first electromagnet again after a specific switch-on time can also be used. Such a device can correspondingly permit both electromagnets to be initially switched on at the start of the active state of the relay, and then the first electromagnet to be switched off after a short time. In this way, the second electromagnet can be provided with more time for its switch-on process, so that it is ensured that the second electromagnet was able to build up a magnetic field with the desired field strength before the first electromagnet is switched off.

The first electromagnet can be a lifting magnet. The lifting magnet can be used for a movement of the contact. A lifting magnet is correspondingly ideally suited to the task of moving the contact from one position into another position.

The second electromagnet can be a holding magnet. Holding magnets do not have an air gap and owing to their design are significantly more powerful than comparable lifting magnets. The holding magnet is ideally configured for the task of keeping the contact in its closed state. In particular, in its closed state the contact can abut the holding magnet and therefore, as it were, adhere thereto.

The relay can also be configured in such a way that the contact is moved from the closed state into the opened state if the second electromagnet is switched off. In this case, neither of the two electromagnets is switched on, with the result that no energy consumption occurs. As a result of the fact that the first electromagnet was already switched off after the closing of the contact, the overall fall-back time during the opening of the contact is very short, since all that is now necessary is to reduce the magnetic field of the second electromagnet, and only small forces therefore occur.

In a switched-on state, the second electromagnet can be operated with lower power than the power with which the first electromagnet is operated in its switched-on state. For example, the second electromagnet can have a power consumption between 50 and 250 mA.

In addition, the first electromagnet can be configured to generate a magnetic field with a higher field strength than the second electromagnet. This relatively high magnetic field is required merely to close the contact.

According to a further aspect, the present invention relates to a contactor which has the relay described above, wherein the relay is arranged in a gas-filled volume. The contactor is a switch for large electrical power levels. Such a contactor is used, for example, in electrically operated vehicles. Accordingly, a direct current with a high current strength can flow between the terminals of the relay. If the contact is then opened, a flashover can occur. However, the gas in this gas-filled volume can impede or reduce the flashover.

The invention will be explained in more detail below with reference to the figures and exemplary embodiments.

Figure 1:
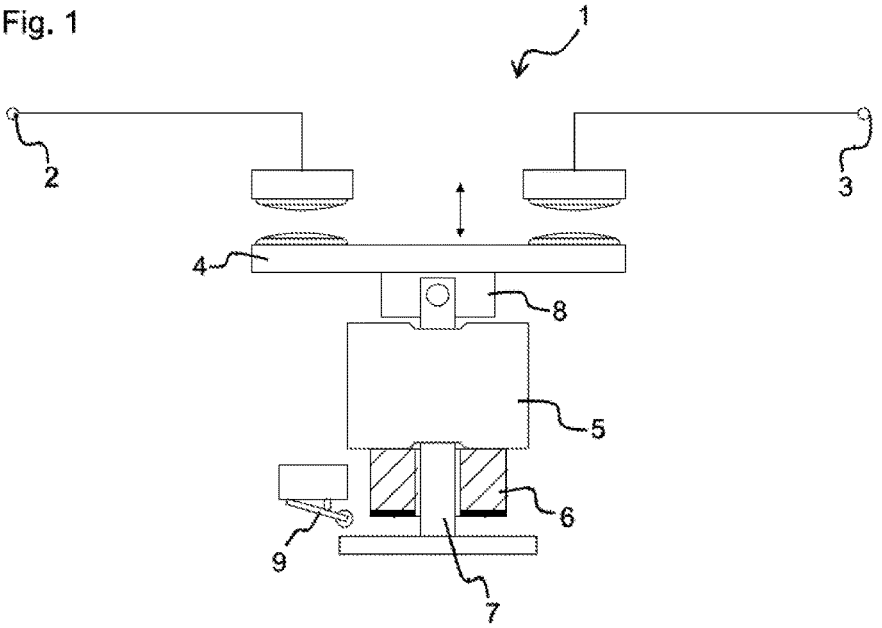
FIG. 1 shows a relay in a state of rest.

FIG. 1 shows a relay 1 which has a first terminal 2 and a second terminal 3. A contact 4 is arranged between the first and second terminals 2, 3. The contact 4 can be either in an open state or in a closed state. FIG. 1 shows the contact 4 in its opened state. In the opened state, the contact 4 electrically disconnects the first and the second terminal 2, 3 of the relay 1 from one another. Accordingly, current cannot flow via the contact 1. The relay 1 is in a state of rest which is characterized in that the contact 4 is in its opened state and accordingly current cannot flow.

The relay 1 also has a first electromagnet 5 and a second electromagnet 6. The first electromagnet 5 and the second electromagnet 6 can be respectively switched on and off. In the state of rest of the relay 1 shown in FIG. 1, the first electromagnet 5 and the second electromagnet 6 are switched off.

The first electromagnet 5 is a lifting magnet. The first electromagnet 5 correspondingly has an armature 7 which is moved from a first position into the second position when the first electromagnet 5 is switched on. FIG. 1 shows the armature 7 in its first position. The armature 7 is mechanically connected to the contact 4. The armature 7 has for this purpose a plate 8 on which the contact 4 is mounted. If the armature 7 is moved from its first position into its second position by the switching the first electromagnet 5 on, this also moves the contact 4. In particular, the contact 4 is as a result moved from its open state into its closed state.

The second electromagnet 6 is a holding magnet. The second electromagnet 6 is dimensioned in such a way that its magnetic field is not strong enough to lift the armature 7 from the first position to the second position, but is strong enough to keep the armature 7 in the second position if it is already in the second position. In the second position, the armature 7 abuts the second electromagnet 6. Accordingly, the second electromagnet 6 is dimensioned in such a way that its magnetic field is not strong enough to move the contact 4 from the opened state into the closed state, but is strong enough to keep the contact 4 in the closed state.

In addition, the relay 1 has a device 9 for switching off the first electromagnet 5. In the exemplary embodiment shown in FIG. 1, this device 9 is a micro switch. The micro switch is arranged in such a way that it is activated by the armature 7 if the armature 7 is moved from its first position into its second position. The first electromagnet 5 is switched off by activation of the micro switch.

Figure 2:
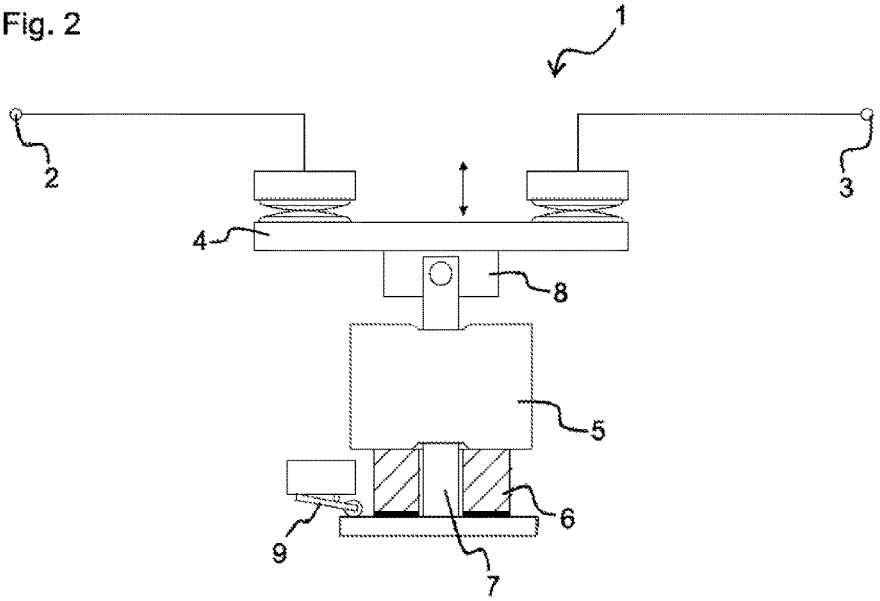
FIG. 2 shows the relay in an active state.

FIG. 2 shows the relay 1 in an active state. The active state of the relay 1 is characterized in that the contact 4 is in its closed state. The relay 1 is moved into the active state as a result of the first electromagnet 5 being switched on. As a result, the armature 7 is lifted from its first position into its second position and in the process closes the contact 4. The first electromagnet 5 is dimensioned, in particular, in such a way that its magnetic field is strong enough to lift the armature 7 from its first position to its second position. The first terminal 2 and the second terminal 3 of the relay 1 are then electrically connected to one another via the contact 4, with the result that current can flow through the relay 1.

The first electromagnet 5 is switched on only in a transition phase between the state of rest of the relay 1 and the active state of the relay 1. In addition, in this transition phase the second electromagnet 6 is also switched on. If the relay 1 has reached its active state, the device 9 is activated to switch off the first electromagnet, and said electromagnet is correspondingly switched off. In particular, the armature 7 activates the micro switch, with the result that the latter switches off the first electromagnet 5.

In the active state of the relay 1, the second electromagnet 6 is switched on. The magnetic field of the second electromagnet 6 is strong enough to keep the armature 7 in its second position, and therefore keep the contact 4 closed.

The method of functioning of the relay 1 has been correspondingly divided into the two sub steps of closing of the contact 4 and keeping the contact 4 in the closed state. The first electromagnet 5 ensures that the contact 5 closes, and the second electromagnet 6 ensures that the contact 4 is kept in the closed state. A significantly stronger magnetic field is necessary to close the contact 4 than to keep the contact 4 closed.

Accordingly, the first electromagnet 5 is dimensioned in such a way that it generates a magnetic field with a higher field strength than the second electromagnet 6. The first electromagnet 5 therefore also requires a higher power consumption. This higher power consumption occurs, however, only during the chronologically short process of closing the contact 4. If the contact 4 is in its closed state, only the second electromagnet 6 is switched on, while the first electromagnet 5 is switched off. Therefore, in the closed state of the contact 4 only the relatively low power consumption of the second electromagnet 6 occurs. For example, in the active state the relay 1 can have a power consumption of 250 mA or less, for example a power consumption in a range between 40 and 250 mA, in particular between 50 and 150 mA.

In order then to reset the relay 1 from its active state to its state of rest, the second electromagnet 6 is switched off. In this case, the contact 4 is no longer kept in the closed state and is correspondingly opened. In particular, in this case the armature 7 is moved from its second position back into its first position.

Since only a low current flows when the second electromagnet 6 is switched off, the overall fall-back time when the contact 4 opens is very short, since only a comparatively small magnetic field has to be removed.

Figure 3:
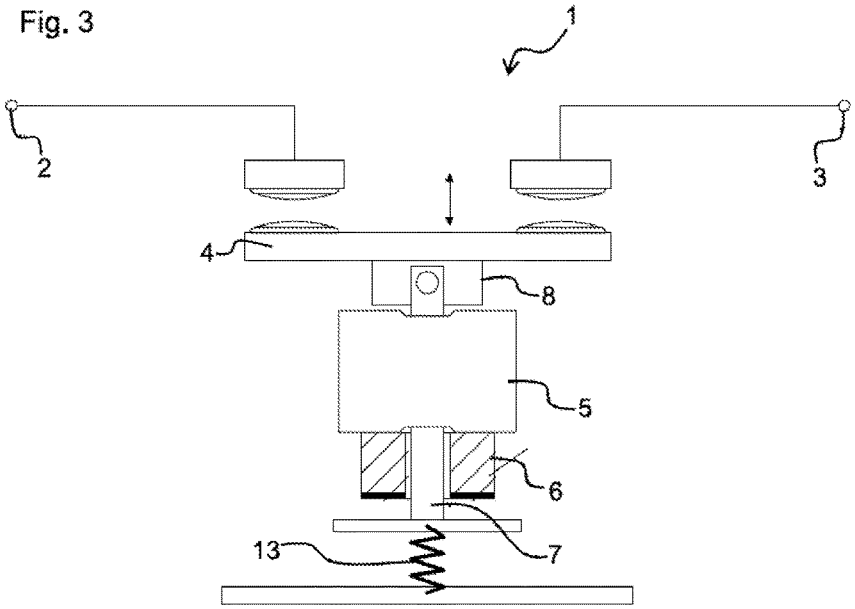
FIG. 3 shows a relay according to a second exemplary embodiment in a state of rest.
Figure 4:
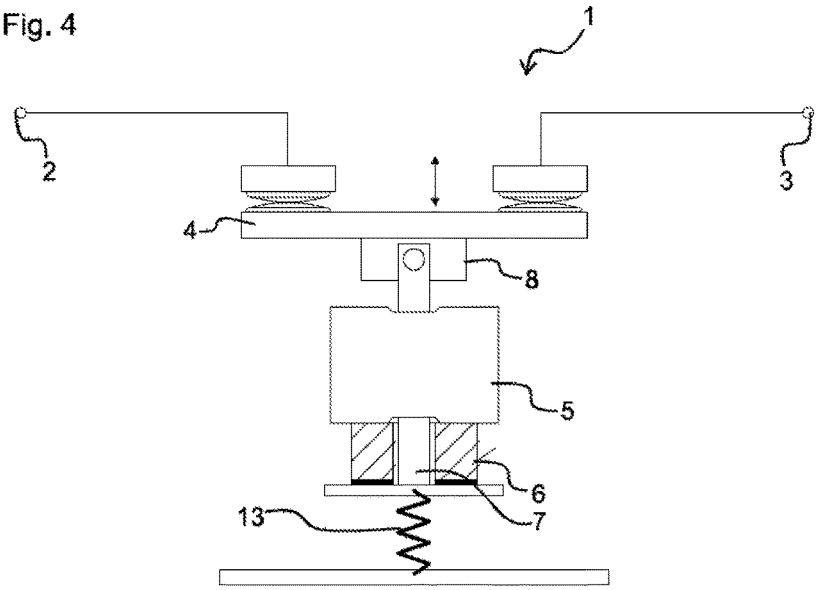
FIG. 4 shows the relay according to the second exemplary embodiment in an active state.

FIGS. 3 and 4 show the relay 1 according to a second exemplary embodiment. In this context, FIG. 3 shows the relay 1 according to the second exemplary embodiment in its state of rest, and FIG. 4 shows the relay 1 in its active state.

The relay 1 according to the second exemplary embodiment differs from the relay 1 shown in FIGS. 1 and 2 in that the armature 7 of the first electromagnet 5 is mechanically connected to a resetting spring 13. If the armature 7 is in its second position, the resetting spring 13 is tensioned and applies a force in the direction of the first position to the armature 7. The resetting spring 13 is, however, dimensioned in such a way that the force applied by it to the armature 7 is not sufficient to overcome the force applied by the second electromagnet 6. Accordingly, the armature 7 remains in its second position as long as the second electromagnet 6 is switched on.

If the second electromagnet 6 is switched off, only the resetting spring 13 continues to act. Said resetting spring 13 then pulls the armature 7 back into its first position, with the result that the contact 4 is opened and the relay 1 is moved into its state of rest. The restoring spring 13 therefore permits the contact 4 to be opened even more quickly, and the relay 1 to be moved more quickly from its active state into its state of rest. The switch-off time of the relay 1 is influenced by the following factors: an electromagnet 5, 6 always attempts to maintain the current state. If the electromagnet 5, 6 is switched off from the energized state, it takes some time until the state of rest is set. In this time, a magnetic force also continues to act on the armature 7. This causes the switch-off process of the relay 1 or the opening of the contact 4 to take a certain time. However, the fastest possible switching off is desired in order to avoid a flashover. Since the first electromagnet 5 is switched off immediately after the switching the relay 1 on, its switch-off period is negligible. In particular, if the first electromagnet is a lifting magnet, it can have a comparatively slow switch-off behavior. However, this is not of further significance since the first electromagnet 5 is switched off while the relay 1 is in its active state. The second electromagnet 6 can be, in particular, a holding magnet which no longer applies any force to the attracted armature 7 immediately after the switching off, with the result that no further influence from the second electromagnet 6 is possible. The contact 4 is therefore also opened very quickly in the exemplary embodiment shown in FIGS. 1 and 2. The opening time of the contact 4 can be shortened even further by the resetting spring 13.

In addition, the relay 1 according to the second exemplary embodiment also differs from the relay 1 shown in FIGS. 1 and 2 in that here the device 9 for switching off the first electromagnet 5 does not have a switch which is activated by the armature 7. Instead, the device 9 has a timer switch which switches off the first electromagnet 5 again after a predefined time after the first electromagnet 5 switches on. This timer switch cannot be seen in FIGS. 3 and 4, but is explained in more detail later.

Figure 5:
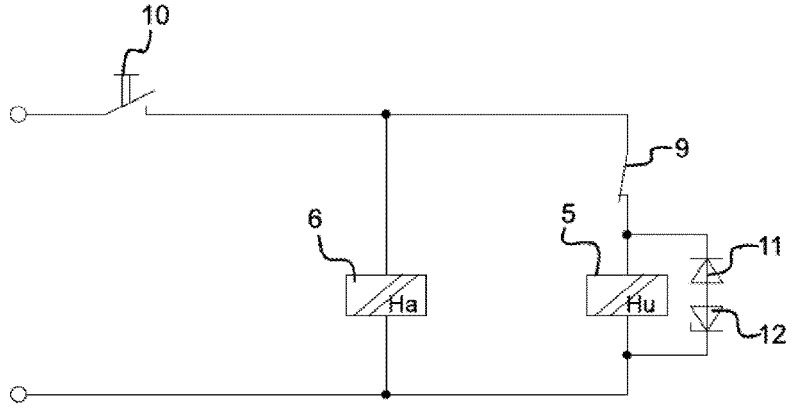
FIG. 5 shows a circuit diagram of the relay.

FIG. 5 shows a circuit diagram of the relay 1. The circuit diagram shows that the first electromagnet 5 and the second electromagnet 6 are connected to one another in parallel. The circuit diagram also has a device 10 for switching the relay 1 on and off. Said device 10 is a switch. If the device 10 is closed in order to switch on, the relay 1 is moved from its state of rest into its active state. In this context, a voltage is firstly applied to the first electromagnet 5 and to the second electromagnet 6, with the result that both electromagnets 5, 6 are switched on.

In addition, the device 9 which switches off the first electromagnet again a short time after it switches on is connected in series with the first electromagnet 5. This device 9 is the micro switch here which is activated by a movement of the armature 7.

The relay 1 which is shown in FIG. 5 is configured in such a way that the first electromagnet 5 is switched off immediately as soon as the contact 4 is in the closed state.

In addition, two diodes 11, 12 which are connected counter to one another are connected in parallel with the first electromagnet 5, wherein the diode 11 is a simple diode, and the diode 12 is a Zehner diode. The two diodes 11, 12 ensure that when the first electromagnet 5 switches off, the voltage is short-circuited and therefore disruptive effects during the removal of the magnetic field are damped. As an alternative to the two diodes 11, 12, a varistor could also be connected in parallel with the first electromagnet 5.

Figure 6:
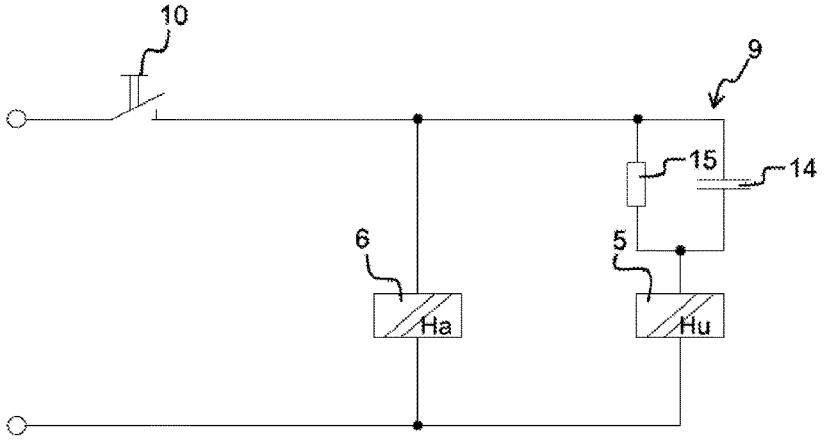
FIG. 6 shows a circuit diagram of the relay according to an alternative embodiment.

FIG. 6 shows a circuit diagram of an alternative embodiment of the relay 1. This relay 1 is configured in such a way that the first electromagnet 5 is switched off after a predefined, preferably very short, time, after the contact 4 has reached the closed state. For this purpose, in the case of the relay 1 the device 9 has a capacitor 14 and a resistor 15 instead of the micro switch. The capacitor 14 is connected in series with the first electromagnet 5. After the relay 1 switches on, firstly a current can flow across the capacitor 14, with which current the first electromagnet 5 is operated. If the capacitor 14 is then completely charged, it switches off, with the result that current no longer flows and the first electromagnet 5 is switched off. Accordingly, the capacitor 14 forms a timer switch which ensures that the first electromagnet 5 is switched off after a predefined time after the closing of the contact 4.

LIST OF REFERENCE NUMBERS

1 Relay
2 First terminal
3 Second terminal
4 Contact
5 First electromagnet
6 Second electromagnet
7 Armature
8 Plate
9 Device for switching off the first electromagnet
10 Device for switching the relay on and off
11 Diode
12 Diode
13 Resetting spring
14 Capacitor
15 Resistor

The invention claimed is:

1. A relay comprising:

a first terminal;

a second terminal;

a contact which in a closed state brings about an electrical connection between the first and second terminals and which in an opened state electrically disconnects the first and second terminals;

an armature which is mechanically connected to the contact;

a first electromagnet which is configured to move the armature from a first position to a second position, thereby placing the contact in the closed state if the first electromagnet is switched on; and a second electromagnet which is an air-gap-free holding magnet and which is configured to keep the armature in the second position and to keep the contact in the closed state if the contact is in the closed state and the second electromagnet is switched on, wherein the armature abuts the second electromagnet in the second position without an air gap in-between, does not abut the second electromagnet in the first position, and does not abut the first electromagnet in the second position, and wherein the first and second electromagnet are arranged displaced from each other along the direction of the movement from the first position to the second position.

2. The relay according to claim 1, wherein the second electromagnet is dimensioned in such a way that its magnetic field is strong enough to keep the contact in the closed state, and that its magnetic field is too weak to move the contact from the opened state into the closed state.

3. The relay according to claim 1, wherein the second electromagnet is further configured to keep the contact in the closed state if the first electromagnet is switched off.

4. The relay according to claim 1, wherein the relay is configured in such a way that the first electromagnet is switched off as a result of the fact that the contact is moved from the opened state into the closed state.

5. The relay according to claim 1, having a device which switches off the first electromagnet if the contact is in the closed state.

6. The relay according to claim 1, wherein the relay has a timer switch which switches off the first electromagnet after a predefined time after the contact has been moved from the opened state into the closed state.

7. The relay according to claim 1, wherein the first electromagnet is a lifting magnet.

8. The relay according to claim 1, wherein the second electromagnet is a holding magnet.

9. The relay according to claim 1, wherein the relay is configured in such a way that the contact is moved from the closed state into the opened state if the second electromagnet is switched off.

10. The relay according to claim 1, wherein the second electromagnet is operated in a switched-on state with a power that is lower than the power with which the first electromagnet is operated in a switched-on state.

11. The relay according to claim 1, wherein the first electromagnet is configured to generate a magnetic field with a higher field strength than the second electromagnet.

12. A contactor, having a relay according to claim 1, wherein the relay is arranged in a gas-filled volume.

* * * * *